United States Patent [19]

Kaman

[11] 4,056,034

[45] Nov. 1, 1977

[54] GUITAR CONSTRUCTION

[76] Inventor: Charles H. Kaman, Prattling Pond Road, Farmington, Conn. 06032

[21] Appl. No.: 679,039

[22] Filed: Apr. 21, 1976

Related U.S. Application Data

[63] Continuation-in-part of Ser. No. 515,364, Oct. 16, 1974, abandoned.

[51] Int. Cl.[2] ..... G10D 1/08

[52] U.S. Cl. ..... 84/267; 84/291

[58] Field of Search ..... 84/267, 290, 291, 292

[56] References Cited

U.S. PATENT DOCUMENTS

| | | | |
|---|---|---|---|
| 1,764,679 | 6/1930 | Gast | 84/267 X |
| 2,793,556 | 5/1957 | Maccaferri | 84/267 |
| 3,443,465 | 5/1969 | Kasha | 84/267 |
| 3,656,395 | 4/1972 | Kaman | 84/267 |
| 3,664,911 | 5/1972 | Takabayashi | 84/291 X |

FOREIGN PATENT DOCUMENTS

| | | | |
|---|---|---|---|
| 584,878 | 11/1958 | Italy | 84/290 |

*Primary Examiner*—Lawrence R. Franklin
*Attorney, Agent, or Firm*—McCormick, Paulding & Huber

[57] ABSTRACT

The hollow body of a guitar has two discrete zones for openings in the sound board, such openings being located on either side of the longitudinal center line defined by the neck and fret board. These openings are located adjacent the periphery of the upper or smaller bout, that is above the waist. The lower bout is slightly larger than the upper bout and is provided with a bridge located below the waist. The tension forces in the strings are reacted through a central portion of the bout in the region where the single conventional sound opening is normally provided. This construction allows for a thinner sound board than has been possible heretofore, which sound board can also be braced by longitudinally extending ribs located below the strings, and can be more conveniently braced to improve its acoustic response.

12 Claims, 12 Drawing Figures

GUITAR CONSTRUCTION

CROSS REFERENCE TO RELATED APPLICATION

This application is a continuation-in-part of U.S. Patent application Ser. No. 515,364, filed Oct. 16, 1974, entitled "Guitar Construction", now abandoned.

The construction disclosed herein is especially suitable for use in a guitar equipped with a sound board of the type described and claimed in my copending application entitled "Sound Board For Stringed Instrument", filed concurrently herewith, and now issued as U.S. Pat. No. 3,880,040.

BACKGROUND OF THE INVENTION

This invention relates to guitars, and deals more particularly with a guitar of the type having a hollow body portion or sound box which cooperates with the sound board portion so as to amplify the fundamental source of sound, namely the vibration of the strings, in order to provide the desired integration of sound produced by the instrument.

Conventional guitar construction techniques call for use of a relatively thin planar sound board, usually of wood, mounted to a somewhat heavier box or bowl. The bowl may be fabricated from fiberglass as shown, for example, in my prior U.S. Pat. No. 3,656,395 issued Apr. 18, 1972. The wood sound board in such a guitar is usually on the order of 0.10 to 0.12 inches in thickness, and it has been found that this dimension leads to desirable tonal qualities in a guitar construction having the necessary strength in the sound board portion of the instrument to support its taut strings. The strings transmit sound vibrations to the sound board through a bridge mounted to the front face of the sound board, and the tension forces in these strings are such that the thin sound board is usually internally braced so as to react such forces. Further, a sound opening must also be provided in the sound board to allow the air contained inside the instrument to be pulsed by the vibrating strings and sound board, and thereby amplified. Thus, the hollow sound box or bowl acts in the nature of an organ pipe in carrying out this function, and the sound produced by a guitar is an integration of the contributions made by the strings, the sound board itself, and the pulsed air in this chamber.

Still with reference to conventional guitar construction techniques, the sound opening is most often located between the bridge and the lower end of the guitar neck portion and more particularly the fret board. Thus, the opening is generally provided in centered relationship on the longitudinal axis of the instrument, and hence is located directly behind the strings themselves. This location for the sound opening has an undesireable effect from the point of view of structural considerations, in that it reduces the sound board's strength in the stress path which reacts the tension forces in the strings, and moments created thereby. As a result of this location for the sound openings, present day guitars usually include rather extensive cross bracing both above and below the sound opening in order to permit the sound board to accommodate the above mentioned stresses in stress paths located on either side of the single sound opening. While additional bracing is often utilized to vary the response characteristic of the sound board with respect to the wide range of frequencies characteristic of guitars generally, it is noted that the rather extensive cross bracing characteristic of present day guitars, especially that bracing located adjacent the sound opening, is in fact necessary for the reacting of these tension forces and moments arising from these tension forces in the strings.

A general object of the present invention, therefore, is to provide a sound board in which the sound opening is relocated in order to obviate the need for such extensive cross bracing, and to permit a larger portion of the sound board itself to be devoted to the achievement of a desired vibration pattern which is related primarily to the acoustic response characteristics of the instrument rather than by structural considerations with respect to reacting the forces of the strings upon this portion of the instrument.

SUMMARY OF THE INVENTION

The present invention resides in a guitar having a hollow body defined in part by a relatively thin sound board. A bridge is attached to the front or exterior surface of the sound board, and transmits sound energy from the vibrating strings to the sound board, causing the sound board to vibrate not only at the fundamental frequency of such vibrating strings, but also to provide a response to many harmonics of these frequencies and particularly the first and second harmonics thereof. The vibrating sound board also pulses the air inside the sound box at certain frequencies, and a pair of discrete zones for the sound openings are provided in the upper bout region of the guitar body adjacent the top side edges of the sound board. This location for these sound openings permits a thinner sound board than has been possible heretofore, and also allows for a unique bracing pattern on the interior surface of the sound board, which pattern can be specifically designed for better acoustic response of the enlarged effective area of the sound board, rather than being dictated primarily by the necessity for reacting the tension forces in the guitar strings.

DETAILED DESCRIPTION

Figure 1:
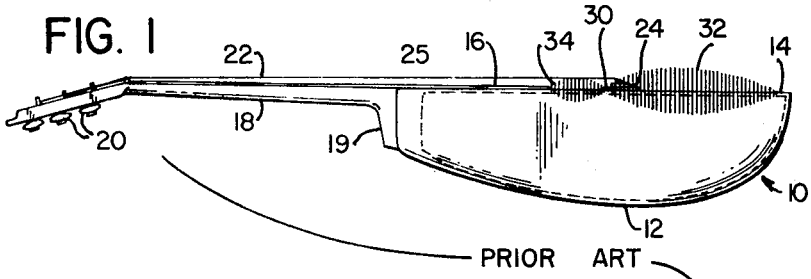
FIG. 1 is a side elevational view of a prior art guitar illustrating in schematic fashion the nodal point adjacent the bridge characteristic of the first harmonic mode of vibration for the sound board as it is affected by the location of a conventionally located single sound opening.
Figure 2:
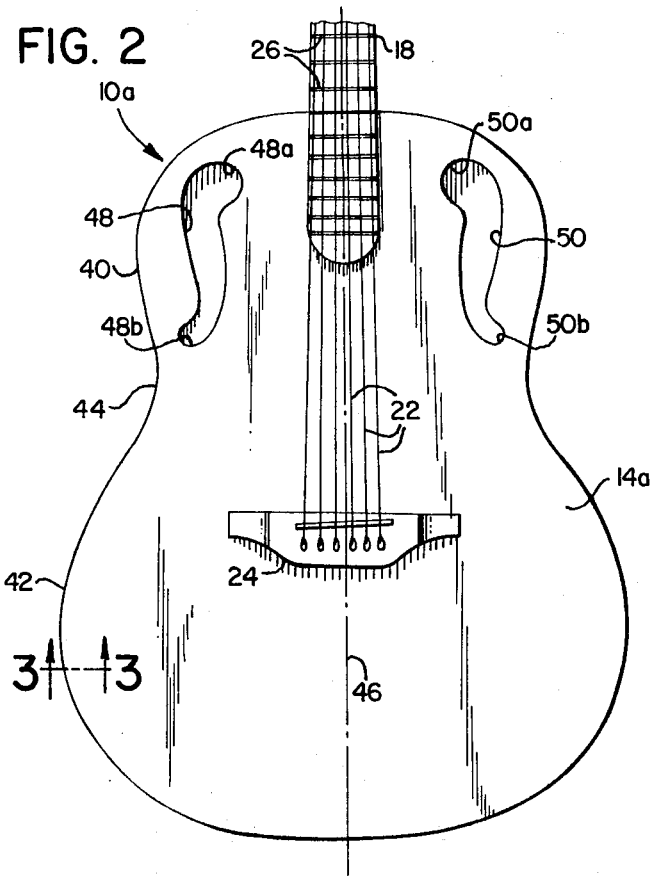
FIG. 2 is a front view of a guitar embodying the present invention with the neck portion of the guitar omitted since such portion is identical to that of the prior art guitar of FIG. 1.

Referring now to the drawings more specifically, FIG. 1 illustrates a contemporary guitar of the type described in my prior above mentioned U.S. Pat. No. 3,656,395. Such a guitar includes a hollow body or sound box 10, which may comprise a one-piece curved bowl 12 and a sound board assembly 14 comprising a generally flat planar diaphragm having a circular opening 16 located on the longitudinal center line of the body 10. A neck portion 18 of the guitar extends from one end of the body 10 and carries string clamping screws, as indicated generally at 20, for tensioning the guitar strings 22, 22. These strings extend from the upper end of the neck 18 to a bridge 24 provided on the exterior surface of the sound board 14, and six such strings are typically provided in a conventional guitar but any number can, of course, be provided, twelve strings also being in common use on present day guitars. As best shown in FIG. 2 the neck 18 defines a series of laterally extending frets 26, 26 which are provided on the upper face of the neck 18 and thereby define a fret board to permit the player to select the proper notes or chords to be played on the instrument.

Contemporary guitars are usually provided with a relatively thin wood sound board, usually of a thickness in the range between 0.1 and 0.12 inches, which sound board is adapted to vibrate in various mode shapes in response to excitation originating in the strings. The sound energy is transmitted to the sound board through the bridge. Because of the relatively high tension loads in the strings, the relatively thin wood sound board must be reinforced on its inner surface by bracing to accommodate this tension. It can be said that much of this bracing serves primarily to prevent undue deflection or distortion in the shape of the sound board in the area between the bridge and the juncture between the neck 18 and the body 10.

As described in the above mentioned prior U.S. Pat. No. 3,656,395 prior art guitars with a center hole, or sound opening, require substantial bracing in order to transfer the string loads into the body of the guitar. More particularly, rather extensive cross bracing is generally provided both above and below the sound opening in the prior art disclosure embodied in said U.S. patent. While the sound board 14 of FIG. 1 is adapted to vibrate in a fundamental mode, which results in the area just below the bridge being vibrated with somewhat greater amplitude than the area adjacent the sound opening 16 and the lower periphery of the bowl, FIG. 1 illustrates the first harmonic of such a fundamental mode induced by the vibrating strings, and illustrates a nodal point 30 located just above the bridge 24. It will be apparent from this schematic illustration of this first harmonic mode of vibration that the location for the sound opening 16 in FIG. 1 does tend to inhibit this first harmonic mode of vibration.

Figure 6:
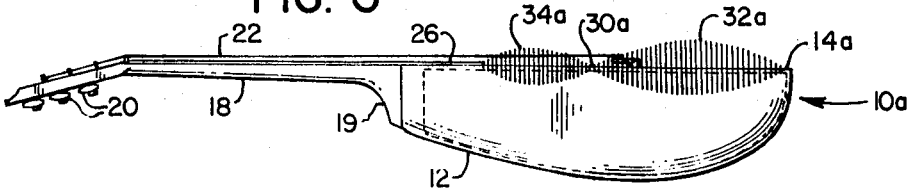
FIG. 6 is a view similar to FIG. 1, but schematically illustrating the first harmonic vibration pattern characteristic of the improved sound board illustrated in FIGS. 2, 3, 4 and 5, and illustrates the effect on this pattern of the novel sound opening locations depicted in FIGS. 2 and 4.

In view of the fact that a guitar generally must have a relatively wide frequency response, it must be responsive to the various harmonic modes of vibration particularly the first harmonic depicted in FIGS. 1 and 6. The upper harmonic modes of vibration are enhanced in the FIG. 6 guitar because a broader area of the central region of the sound board is activated than is the case with the FIG. 1 guitar. The basic tonal qualities of a guitar type instrument are derived from its response to the first and second modes. (See FIG. 7). The guitar construction to be described hereinbelow permits the thin sound board of a guitar to respond to these higher harmonic modes, and particularly to the first harmonic mode of vibration as illustrated schematically in FIG. 6. FIG. 6 shows the nodal point **30*a* for such second mode as being located in approximately the same position as that depicted in FIG. 1 for the contemporary prior art guitar construction, but it will be apparent that the sound board 14*a* of FIG. 6 is adapted to vibrate with an amplitude which yields a considerably greater response especially in the upper bout region as indicated generally at 34*a* in FIG. 6. Compare the schematic representation of these vibrations at 32 and 34 of FIG. 1 with those depicted in FIG. 6 at 32*a* and 34*a*** respectively.

Figure 7:
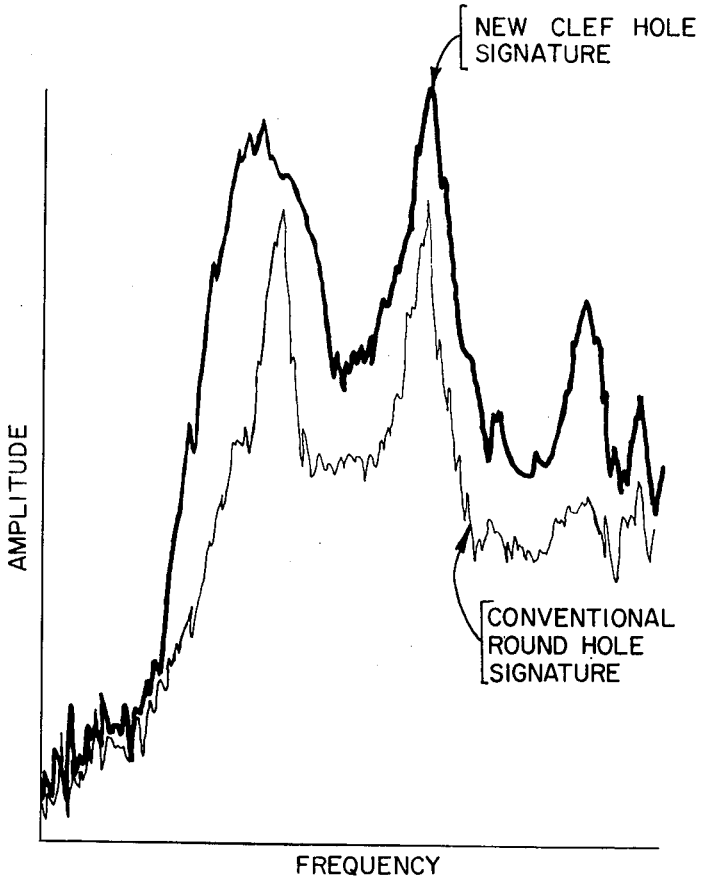
FIG. 7 is a graphical presentation of the acoustic signatures obtained from two similarly constructed sound boards, the lighter line illustrating the response characteristics of the board with a conventional round hole located as in FIG. 1A, the darker line illustrating the improved results with the FIG. 2 sound holes.

Referring now to FIG. 7 in particular, the two "signatures" there illustrated were obtained from two similarly constructed sound boards, save only for the location and number of the sound openings. As indicated, the "signature" of an instrument of the type depicted in FIG. 1A exhibits very noticeable amplitude peaks at the frequencies associated with the fundamental, and its harmonics. By way of comparison, the FIG. 2 guitar widens these peaks, especially at the base of each, and also fills in the valleys between these peaks. Some overall amplitude increases are also noticeable, but the more marked improvement in the FIG. 2 instrument's tonal quality can be attributed to the improved response characteristics of the fundamental mode and the first and second harmonic modes of vibration. The remaining portion of this disclosure deals with structural modifications to the sound board, and more particularly to a unique bracing system made possible as a direct result of the sound hole relocation discussed above. It is noted that these relocated openings are placed in a much stiffer area than is the conventional round hole, a factor which itself provides the bracing designer with a less arduous task than heretofore.

FIG. 2 shows in plan view the configuration of a body portion **10*a* for a guitar embodying the present invention. The sound board 14*a* may be of the same general type as that referred to hereinabove, namely said sound board may comprise an upper bout 40 which is slightly smaller in contour than the lower bout 42 and which is separated therefrom by a waist portion 44 in accordance with conventional practice. The sound board has a longitudinal axis 46** which separates the sound board into a region which will be referred to herein as a bass side and a treble side. However, this terminology is not intended to limit the function of each side of the guitar, but is adopted herein solely for purposes of aiding in the description of the sound board.

Further, and with particular reference to the sectional view taken on line 3—3 of FIG. 2, the sound box shown comprises a fiberglass bowl or body 12 which supports the sound board **14*a*, and a plastic molding or strip 46 inside the sound box facilitates joining of the sound board to the body. However, the body 12** might also be fabricated of wood or other material, and might have configurations other than the bowl shape shown without departing from the scope of the present invention.

Referring again to FIG. 2 a conventional bridge 24 is provided on the exterior surface of the sound board 14*a* and carries the ends of the various guitar strings 22, 22 which extend across and above the frets 26, 26 defined for the purpose on the fret board portion of the neck 18 as shown.

Figure 9:
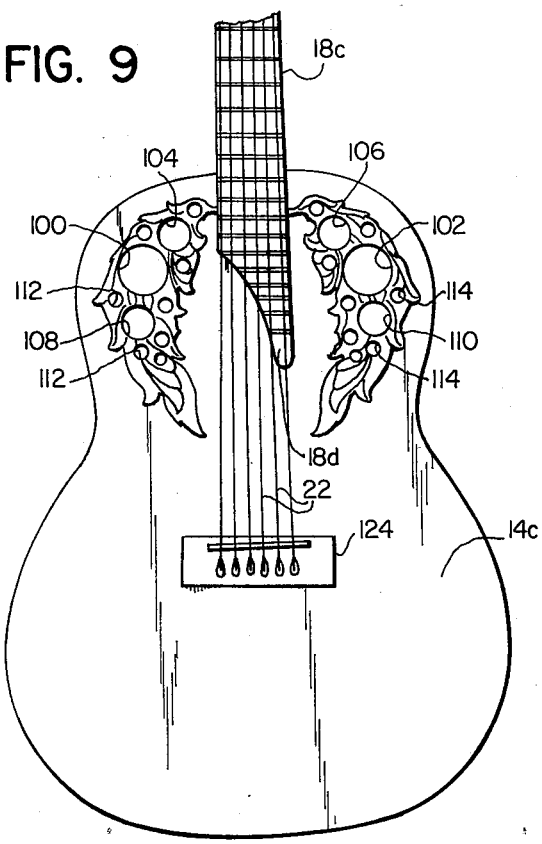
FIG. 9 is a view similar to FIG. 2 above, but illustrating an alternative arrangement of the sound openings.
Figure 10:
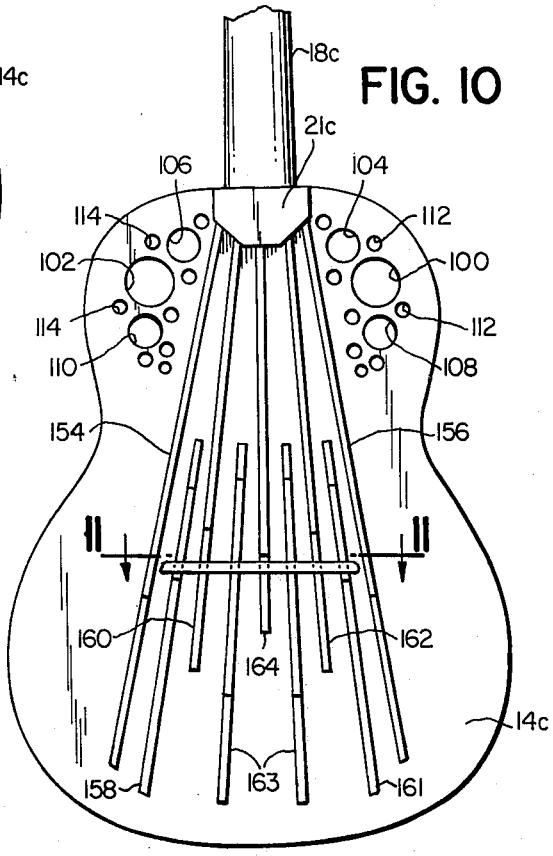
FIG. 10 is a view similar to FIGS. 4 and 8, but illustrating a second alternative bracing configuration.

In accordance with the present invention no circular opening is provided in centered relationship on the longitudinal axis 46 of the guitar body, but rather, bass and treble zones are provided for sound openings 48 and 50 in the upper bout adjacent the periphery of the sound board. As shown in FIG. 2 two openings, 48 and 50, of serpentine or clef shape are provided and each of these openings includes upper scroll portions 48*a* and 50*a* respectively which are turned inwardly, that is which face the neck portion 18 of the guitar, and these openings 48 and 50 further include outwardly turned lower scroll portions 48*b* and 50*b* which project outwardly toward the periphery of the lower area of the upper bout 40. Although two serpentine shape openings are shown in FIG. 2 several smaller openings might be arranged in the zones for these openings, and FIGS. 9 and 10 illustrate one such hole configuration to be described hereinbelow.

Still with reference to FIG. 2, the sound openings 48 and 50 are completely defined in the upper region of the guitar's sound board, that is they are located well above the waist 44 of the guitar. Thus, the important feature of these openings is their locations or zones in the sound board. It has been found that providing sound openings in the area of the sound board below the waist tends to detract from the instruments response to the lower or bass frequencies. Thus, in the guitar sound board depicted in FIG. 2 it will be noted that the bridge 24 is provided in generally centered relationship in that portion of the sound board which is free from attachment to the underlying sound box 12, which sound board portion is also free from the presence of openings or the like. The response characteristics of a sound board, especially in the frequency range between the first natural frequency mode of vibration and the second mode or first harmonic of such natural freqency, are influenced by the sound opening in that the air adjacent the board is also vibrated. However, the very presence of such a sound opening affects the vibration response of the sound board since there is, of course, no structure to vibrate in the area of the sound hole or holes. It is further noted that the total area of the openings 48 and 50 will correspond quite closely to the total area provided in the single opening of a conventional guitar sound board of the same general size and type. However, unlike the conventional guitar the present invention calls for these holes to be located in discrete bass and treble zones adjacent the curved periphery of the upper left and right hand quadrants of the sound board. Where more than one opening is provided in each zone, the total area of all openings may nevertheless correspond closely to the total hole area of a conventional guitar. Such a hole configuration is shown in FIG. 9.

The importance of the sound hole configuration in a relatively thin sound board cannot be overemphasized. Prior art sound boards have been built with thickness of 0.10 to 0.12 inches. The next generation of guitars will have much thinner sound boards, on the order of 0.05 inches or less, as disclosed in my above mentioned U.S. Pat. No. 3,880,040. The sandwich type laminated sound board disclosed therein has such a thickness, and the use of thin inner and outer layers of graphite fiber plies, with a wood core therebetween, provides a significant improvement in the quality of sound, particularly in the "sustain" of the instrument, that is in its ability to slow down the rate of decay of a note or chord.

It will be apparent that the thinness of the sound board, made possible by this laminated construction, is enhanced by locating the sound openings in discrete zones wherein these openings are spaced laterally from the longitudinal center line, or axis of the instrument, and hence do not interfere with the ability of the sound board and its bracing to efficiently react the tension forces and moments of the taut guitar strings.

A presently preferred form for the configuration of the sound openings in the bass and treble zones is shown in FIG. 9, wherein a plurality of circular openings 100–114 are provided in a pair of relatively closely spaced clusters adjacent the curved periphery of the upper bout, and well above the location for the bridge 124, in the laminated sound board 14*c*. The neck 18*c* may be similar to the neck 18 of FIG. 2 but preferably has a depending portion 18*d* on the treble side to provide room for additional frets for the smaller strings 22. As shown in FIG. 9 a scroll design is inlaid or embossed on the sound board to lend a pleasing appearance to the pattern of circular holes.

The circular openings 100–114 are symmetrically arranged about the instrument's axis in discrete bass and treble zones and as shown in FIGS. 9 and 10 at least two, and preferably three, of these openings in each zones are larger than the others so that the smaller openings are clustered around the larger ones to keep the openings themselves adjacent the curved periphery of the upper bout and spaced laterally from one another to provide sufficient space for the bracing pattern of FIG. 10. Each hole configuration in each sound opening zone is outboard of the stringers 154 and 156, to be described, and a central opening within each zone 100 and 102 is generally centered between these stringers and the curved periphery of the upper bout as shown in FIG. 10.

Each such hole configuration further includes two additional openings, 104, 108; and 106, 110 respectively arranged in a closely spaced cluster with respect to one of these central openings 100 and 102, respectively. Smaller openings 112, 112 and 114, 114 are provided in the remaining areas of these bass and treble sound opening zones, that is in closely clustered configuration to achieve the same basic purpose as that set forth for the serpentine shaped openings of FIG. 2. That purpose it will be recalled was to provide the necessary porting for the sound box without adversely affecting the response characteristics of the sound board, and without interfering with the bracing requirements of very thin sound boards.

Figure 4:
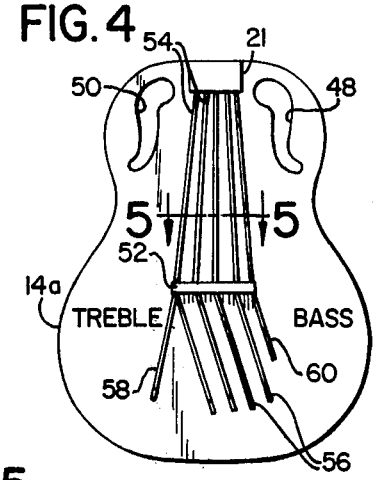
FIG. 4 is a view of the interior surface of the sound board shown in the instrument of FIG. 2.
Figure 3:
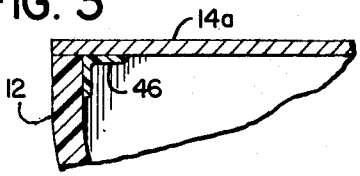
FIG. 3 is a sectional view taken generally on the line 3—3 of FIG. 2.
Figure 5:
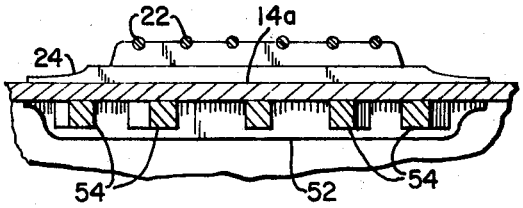
FIG. 5 is a sectional view taken generally on the line 5—5 of FIG. 4.

Turning next to a consideration of one possible internal bracing configuration in a guitar sound board of the type shown in FIG. 2, or FIG. 9. FIG. 4 shows the opposite surface, or interior face of the sound board 14*a* of FIG. 2, with the openings 48 and 50 being provided on the bass and the treble sides of the sound board 14*a* as described above. In its presently preferred form this bracing takes the form of a single laterally extending cross brace 52 located behind the bridge structure 24, and a plurality of longitudinally extending stringers 54, 54 extending upwardly from the cross brace 52, generally to join the lower end of the neck portion 18 of the guitar, and more particularly to the depending knee portion 19 thereof. The term neck as used herein should also be taken to include a neck block 21 inside the bowl and attached to the heel portion 19. As shown in FIG. 4 five such longitudinal stringers are provided, and these fan outwardly slightly, from the neck block 21, or lower end of the neck 18 to accommodate the width of the cross brace 52. The cross brace 52 is preferably at least as long in the lateral direction as is the spread of the guitar strings supported by the bridge structure 24. As best shown in FIG. 5 these stringers 54, 54 may be of generally rectangular or trapezoidal cross section and are at least as great in their lateral dimension as is the thickness of the sound board 14*a.* These stringers 54, 54 may be made from wood such as spruce or a similar material of corresponding strength to weight ratio.

The bracing described in the preceding paragraph is actually intended to stiffen the sound board in the region between the bridge 24 and the neck block 21, and therefore does function so as to provide a stress path for the reaction forces necessary to accommodate the tension in the guitar strings and the moments created thereby. However, additional bracing may be provided below the cross brace 52 in the lower bout region of the guitar sound board to tune the instrument, and enhance its upper harmonic frequency response characteristics. For example, said additional bracing may take the form of a plurality of obliquely arranged stiffeners 56, 56 extending downwardly and outwardly into the bass side of the sound board. As shown, four such stiffeners are provided, and in addition, a single stiffener, indicated generally at 58, extends obliquely in the opposite direction, and into the treble side of the guitar sound board. A single stiffener 60 may complete the acoustic bracing of the guitar sound board 14*a.* It should be noted that this particular stiffener pattern is preferred to achieve certain acoustic response characteristics in the bass and treble range, but that other patterns might also be devised.

Figure 8:
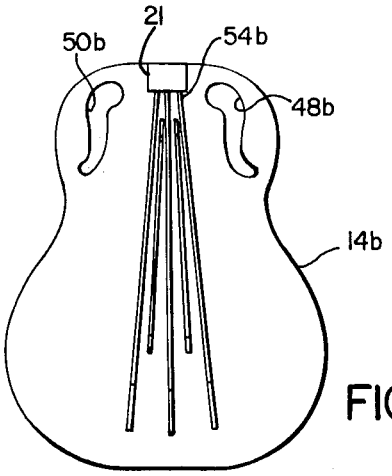
FIG. 8 is a view similar to FIG. 4 above, but illustrating an alternative bracing configuration for the sound board of FIG. 2.

FIG. 8 shows an alternative bracing pattern suitable for use on a guitar sound board of the type shown in FIG. 2 or FIG. 9. The FIG. 8 pattern differs from that of FIG. 4 chiefly in that no cross brace behind the bridge is used in the FIG. 8 version. Rather, the longitudinally extending stringers themselves extend downwardly beyond the area behind the bridge, and fan out slightly into the bass and treble sides of the lower bout to achieve the desired tuning of the instrument as discussed previously with reference to the stiffeners 56, 56 of FIG. 4.

Figure 1A:
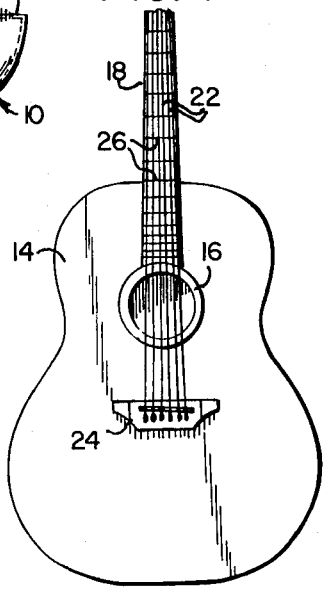
FIG. 1A is another view of the FIG. 1 guitar.

The FIG. 8 bracing pattern is especially suitable for use in reacting the tension forces of the strings, and the moments imposed thereby, without incurring any acoustic response penalty due to cross bracing of the type required in a sound board with a conventionally located single sound hole as shown in FIGS. 1 and 1A.

FIG. 10 shows still another alternative bracing pattern suitable for use on a guitar sound board of the type shown in FIG. 2 or FIG. 9. As shown the sound board 14*c* of FIG. 9 is shown from the inside as having the bass and treble clusters of circular holes in each of the discrete sound opening zones as described above. The FIG. 10 pattern differs from those of FIG. 4 and FIG. 8 chiefly in that the cross brace 152 behind the bridge 124 has the advantage of contributing structure to the efficient reaction of the string forces and moments, per FIG. 2, but without the adverse affects on acoustic response characteristic of the FIG. 2 brace 52. The absence of such a brace allows for free vibration modes for the sound board 14 in FIG. 8, but in FIG. 8 the lack of such a brace may not provide adequate structure for reacting the forces and moments imposed by the taut strings.

The brace 152 has openings 152*a,* 152*b* etc. through which the stiffeners 158–161 extend without being affected thereby. Two stringers 154 and 156 are provided outside the brace 152 and these two are connected to the neck block 12*c,* and are of somewhat greater length and cross sectional size than the other stringers 158–161. Of the latter group of stringers, two of them 160 and 162, extend upwardly to join the neck block 21*c* and two smaller size stiffeners 163, 163 are not so connected to the block 21*c.* Finally, a single center stiffener 164 is connected to the neck block 21*c* to complete the FIG. 10 bracing pattern.

Figure 11:
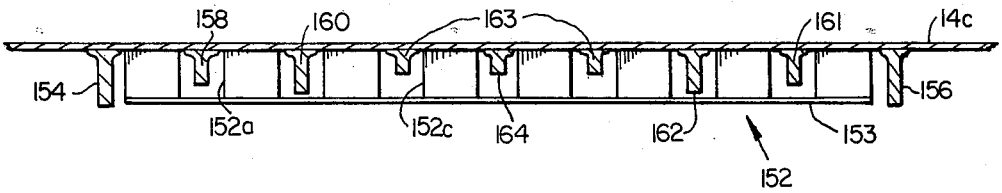
FIG. 11 is a sectional view taken generally on the line 11—11 of FIG. 10.

The sound board 14*c* of FIGS. 9–11 inclusively, is preferably laminated as disclosed in my issued U.S. Pat. No. 3,880,040, and such disclosure is incorporated by reference herein particularly as to the thickness (0.05 inches or less) of the laminated sound board made possible as a result of its unique laminated construction. Thus, the sound board 14*c* has inner and outer layers of fiber strengthened material (such as graphite fibers embedded in a resin matrix with a thickness of no more than 0.02 inches) and one or more medial plies sandwiched therebetween. These medial plies provide a wood-like core (that is a core of elasticity and density similar to that of wood) well adapted to provide the brilliant tonal qualities and "sustain" set forth hereinabove and in the said U.S. Pat. No. 3,880,040.

It should also be noted that the brace 152 is actually of composite laminated construction, and that this brace 152 has a series of spaced wood blocks defining the openings 152*a,* 152*b* etc., which blocks are cemented to the inside fiber strengthened layer of the sound board 14*c,* and which blocks are also provided with a thin member 153 cemented thereto, said member 153 being itself of the same laminated construction as is the top 14*c.* That is, the thin member 153 is also laminated, comprising a piece of approximately the same thickness (0.05 inches) as that specified for the sound board in the aforesaid U.S. Pat. No. 3,880,040.

By way of summary, relocating the reflex porting to the uppermost region of the guitar, as shown in the two embodiments of FIGS. 2 and 9, permits a more acoustically efficient bracing system to be located in the central section of the guitar sound board, which bracing system may be considerably lighter than that possible with a conventional sound opening on the longitudinal axis of the guitar sound board, with the result that a higher level of flexibility can be tolerated in both the bracing and the sound board itself. This increase in flexibility is without compromise to the design strength required to avoid deflection and deformation in the area between the bridge and the edge of the conventional circular sound opening, or the lower end of the finger board. As a result, the response characteristics of the sound board assembly, especially in the region of the second fundamental mode of bending, that is the first harmonic of the fundamental frequency for the sound board assembly, is greatly enhanced. The tonal qualities of the resulting guitar are thereby greatly improved, perhaps due in part to the sound board's enhanced ability to accommodate other modes of vibration in the higher frequency spectrum. Certainly, the occasionally encountered tendencies of prior art sound boards to exhibit deflection and deformation because of string tension have been all but eliminated. Conventional guitars sometimes exhibit a large bubble or swelling in the vicinity below the bridge, and a dishing effect between the conventional sound hole and the bridge due to the forces set up by the strings. In the guitar constructions disclosed herein a very efficient bracing pattern is realized, and the necessary bracing can be designed with considerably less mass, and still be quite capable of withstanding the loads imposed upon the sound board by the taut strings. The resulting sound board assembly provides a system which is made considerably less stiff, and hence is more susceptible to accommodating the various modes of vibration generated in the instrument. This stiffness reduction is achieved in a guitar construction without sacrifice to other equally important parameters, such as the designers ability to vary the sound board stiffness at discrete areas in order to produce the desired sound from a particular instrument.

I claim:

1. A guitar having a hollow body portion and a neck portion the lower end of which is attached to and extends upwardly from said body portion so that the upper end of said neck is adapted to support the upper ends of the guitar strings, said body portion including a sound board with interior and exterior surfaces, a bridge mounted to said sound board for supporting the lower ends of the guitar strings so that the string vibrations are transmitted to the sound board, said sound board having a longitudinal axis coincident with said neck portion, said sound board having a bass and a treble side located on either side of said longitudinal axis, said sound board also including upper and lower bouts defining a waist therebetween, and said bridge located below said waist in said lower bout, a bass and treble sound opening in said upper bout, said openings located in laterally spaced relationship with respect to the longitudinal axis of said sound board, said sound board comprising bracing secured to its interior surface, said bracing including a plurality of longitudinally extending stringers arranged generally symmetrically and between said sound board openings and a cross brace located behind said bridge, said stringers extending upwardly from said cross brace to the lower end of said guitar neck, and at least one sound board stiffener extending obliquely from said cross brace into the bass side of the lower bout of said sound board.

2. A guitar having a hollow body portion and a neck portion the lower end of which is attached to and extends upwardly from said body portion so that the upper end of said neck is adapted to support the upper ends of the guitar strings, said body portion including a sound board with interior and exterior surfaces, a bridge mounted to said sound board for supporting the lower ends of the guitar strings so that the string vibrations are transmitted to the sound board, said sound board having a longitudinal axis coincident with said neck portion, said sound board having a bass and a treble side located on either side of said longitudinal axis, said sound board also including upper and lower bouts defining a waist therebetween, and said bridge located below said waist in said lower bout, and a bass and a treble sound opening zone in said upper bout, said zones located in laterally spaced relationship with respect to the longitudinal axis of said sound board, each zone including at least one sound opening adjacent the periphery of said upper bout and above said guitar waist, said sound board having no sound openings other than those in said discrete zones, a plurality of sound openings in each of said zones, bracing secured to the interior surface of said sound board, said bracing including at least one longitudinally extending stringer arranged generally symmetrically and between said sound board opening zones, said stringer extending from said neck portion downwardly into said lower bout at least to the location of said bridge.

3. A guitar as defined in claim 2 wherein the number of said longitudinal stringers comprises at least three.

4. A guitar as defined in claim 2 wherein said sound board opening zones are spaced a substantial distance above the location of said bridge in said lower bout.

5. A guitar as defined in claim 2 wherein said bracing further includes a cross brace located behind said bridge said stringer extending beyond said cross brace further into said lower bout.

6. A guitar as defined in claim 5 wherein said sound board has a thickness of less than 0.05 inches.

7. A guitar as defined in claim 5 wherein said sound board comprises a laminated construction with outer and inner layers of fiber strengthened material and at least one core ply therebetween having a modulus of elasticity and density similar to that of wood.

8. A guitar as defined in claim 5 wherein the number of said stringers comprise at least three, and at least one stringer extending downwardly into said lower bout beyond said cross brace.

9. A guitar as defined in claim 2 wherein each of said bass and treble sound board opening zones has at least two circular openings and smaller openings clustered around said circular openings so that the openings are adjacent the curved periphery of said upper bout.

10. A guitar as defined in claim 2 wherein said sound board has a thickness of less than 0.05 inches.

11. A guitar as defined in claim 2 wherein said sound board comprises a laminated construction with outer and inner layers of fiber strengthened material and at least one core ply therebetween having a modulus of elasticity and density similar to that of wood.

12. A guitar as defined in claim 11 wherein said sound board has a thickness of less than 0.05 inches.

* * * * *